US005180528A

United States Patent [19]

Kaplan

[11] Patent Number: 5,180,528

[45] Date of Patent: Jan. 19, 1993

[54] APPARATUS AND METHOD FOR FLUID DISTRIBUTION IN A COOLING TOWER

[75] Inventor: Vladimir Kaplan, Silver Spring, Md.

[73] Assignee: AMSTED Industries Inc., Chicago, Ill.

[21] Appl. No.: 738,444

[22] Filed: Jul. 31, 1991

[51] Int. Cl.[5] ..... B01F 3/04; B01F 5/20

[52] U.S. Cl. ..... 261/111

[58] Field of Search ..... 261/110, 111

[56] References Cited

U.S. PATENT DOCUMENTS

| | | | |
|---|---|---|---|
| 3,268,217 | 8/1966 | Goitein | 261/110 |
| 4,032,604 | 6/1977 | Parkinson et al. | 261/111 |
| 4,579,692 | 4/1986 | Bugler et al. | 261/111 |
| 4,592,878 | 6/1986 | Scrivnor | 261/110 |
| 4,720,358 | 1/1988 | Cropp | 261/111 |
| 4,981,265 | 1/1991 | Buhlmann | 261/97 |

OTHER PUBLICATIONS

Baltimore Aircoil Co. CFT Cooling Tower Product Bulletin, p. 4, Printed 1984 in U.S.A.

Baltimore Aircoil Co. FXT Cooling Tower Product Bulletin, pp. 3,5, and 11-13, Printed 1990 in U.S.A.

Baltimore Aircoil Co. Drawing No. 9101, dated Jul. 10, 1991.

Baltimore Aircoil Co. Series 3000 Product Bulletin, p. 6, Printed 1990 in U.S.A.

Baltimore Aircoil Co. JCF/JCT Product Bulletin, p. 4 under heading "3 Quiet Sides" Printed 1990 in U.S.A.

*Primary Examiner*—Tim Miles

*Attorney, Agent, or Firm*—Edward J. Brosius; F. S. Gregorczyk

[57] ABSTRACT

A bottom fed fluid distribution system is provided which may be used to uniformly distribute fluid to an underlying structure. The distribution system comprises a distribution pan, fluid transporting flume, and inlet chamber. The fluid transporting flume is positioned inside the back edge of the distribution pan and is elevated above the bottom of the pan. The flume has an opening in its bottom to allow fluid to flow downwardly into the distribution pan. The inlet chamber is located at the back edge and at one side of the distribution pan. Fluid flows into the bottom of the inlet chamber and then into the flume. As the fluid is flowing all along the length of the flume, a portion of the fluid flows downwardly through the opening in the bottom of the flume and into the distribution pan.

15 Claims, 3 Drawing Sheets

APPARATUS AND METHOD FOR FLUID DISTRIBUTION IN A COOLING TOWER

FIELD OF THE INVENTION

This invention relates generally to an improved fluid distribution system. Specifically, this invention provides uniform fluid head to the distribution pan in an asymmetrically fed distribution system. It is expected this invention will find substantial application in the area of crossflow evaporative water cooling towers.

BACKGROUND OF THE INVENTION

Evaporative water cooling towers are well known in the art. These towers have been used for many years to reject heat to the atmosphere. Evaporative water cooling towers may be of many different types including counterflow forced draft, counterflow induced draft, crossflow forced draft, crossflow induced draft, hyperbolic, among others.

Evaporative water cooling towers are used in a variety of applications. For example, such towers are used to provide cooling water to industrial processes such as food processing operations, paper mills, and chemical production facilities. Large, concrete hyperbolic towers are used to supply cooling water to electricity production plants operated by the electric utilities. A very large area of application for cooling towers is the area of comfort cooling, or air conditioning systems. In these systems, evaporative cooling equipment is utilized to provided cooling water needed in the condensing operations of the refrigeration system.

Crossflow type evaporative cooling towers could be utilized in either comfort cooling or industrial cooling applications. Crossflow cooling towers typically include a heat transfer surface often comprising a plurality of fill sheets grouped together and supported by the tower structure. Water is distributed from a distribution system gravitationally downwardly through the fill sheets, spreading out across the fill sheets to maximize the water's surface area. As water flows down the fill sheets, air is drawn across, or blown through, the fill sheets in a direction that is 90° transposed from the direction of water flow. As the air contacts the water, heat and mass transfer occur simultaneously, resulting in a portion of the water being evaporated into the air. The energy required to evaporate the water is supplied from the sensible heat of the water which is not evaporated. Accordingly, the temperature of the non-evaporated water remaining in the tower is reduced and cooling is accomplished. The cooled water remaining in the tower is typically collected in a cooled water sump which is generally located at the bottom of the tower structure. From this collection sump, the water is pumped back to the heat source where it picks up additional waste heat to be rejected to the atmosphere. The air into which the water is evaporated is exhausted from the tower.

The design of the water distribution system in a crossflow type cooling tower is important for maximum operating efficiency of the equipment. The purpose of the distribution system is to evenly distribute the hot water to be cooled to the underlying heat transfer surface. Uneven distribution of water to the heat transfer surface will reduce the available air-to-water interfacial surface area which is necessary for heat transfer. Severe maldistribution of the hot water to be cooled may result in air flow being blocked through those areas of the heat transfer media which are flooded with water while at the same time causing air to pass through those areas of media which are starved of water.

Distribution systems used on crossflow cooling towers are generally of the gravity feed type. Such systems typically comprise a basin or pan which is positioned above, and extends across the top of, the heat transfer media. Water nozzles, or orifices, are arranged in a pattern in the bottom of the basin. Distribution systems are typically designed to receive water from above and distribute the water to the nozzles within the basin.

The nozzles operate to pass water contained in the basin through the bottom of the basin and then to break-up the water into droplets and uniformly distribute the water droplets across the top of the heat transfer media. The amount of water which passes through the nozzles depends upon the size and type of the nozzle and the head of water above the nozzle. For ease of design and manufacture, it is desirable for a given basin to contain nozzles of only one size and type. As a result, the major variable affecting the rate of water flow through the various nozzle within the basin is the head of water above the nozzle. Accordingly, it is critical to uniform water distribution that the head of water above the nozzles be equivalent throughout the distribution basin.

Due to the size of the typical crossflow cooling tower, it is often difficult to achieve uniform water head within the distribution basin. Generally, the hot water to be cooled is supplied to the distribution basin from a single pipe centrally located above the basin. In most cases, the basins are 8–12 feet in length. As a result, the water must travel at least 4–6 feet within the basin to reach the nozzles furthest from the supply pipe.

Further complicating the situation is the fact that the water flow rates within a single basin may range from 300 gpm up to 2000 gpm, and more. Flow of this magnitude within a basin of average size creates a substantial degree of turbulence making uniform water head within the basin difficult to achieve. In addition, when water flow rates approach maximum levels, the velocity of water traveling from the center of the basin to the far edges of the basin reach very high levels. Such velocities can cause the water to "shear" across the tops of the nozzles close to the inlet pipe, not allowing the water to turn downward through the nozzles in this area. Such a condition can cause a reduced flow through these nozzles even though sufficient water head exists.

Various methods have been utilized to promote even water distribution in crossflow cooling towers. One such method incorporates the use a diffuser box. The hot water supply piping is connected from above to the diffuser box which is centrally located above the basin. The diffuser box has openings in its bottom which when taken as a whole, have a greater cross-sectional flow area than the hot water supply piping. Accordingly, the velocity of the water exiting the diffuser box is less than the velocity of the water exiting the supply piping. Such boxes also generally contain internal baffles to assist in directing the water out of the bottom of a box at an angle toward the basin edges rather than directing the water vertically downward into the basin.

Another method of providing uniform water distribution to a cooling tower having a basin fed from a centrally located overhead supply piping is described in U.S. Pat. No. 4,579,692. The distribution system described in this patent utilizes a stilling chamber and a flume which is positioned within the distribution pan.

The longitudinal axis of the flume is aligned with the longitudinal axis of the basin. One end of the stilling chamber is connected to the hot water supply piping and the other end is connected to the flume at its center, effectively dividing the flume into two sections, each section extending from the center of the basin to one edge. The hot water from the supply piping flows into the stilling chamber and then into the flume. As the water enters the flume, it is divided into two equal streams which flow in opposite directions. As the water is flowing down the flume, it overflows the sides of the flume into the basin thereby providing uniform water distribution throughout the length of the basin.

In other crossflow cooling towers, the hot water to be cooled has been fed to the distribution pan by the use of a flume positioned at the back side of the distribution pan with the longitudinal length of the flume being parallel to the longitudinal axis of the distribution pan. In these cases, the hot water is fed to the center of the flume from above.

In one such arrangement, the flume included a baffle which was sloped downward from the center of the front side of the flume to the ends of the flume. The baffle was positioned above an opening in the bottom of the side of the flume adjacent to the section of the distribution pan in which the nozzles were located. Water would flow down into the flume and a portion would be directed to the ends of the flume by the sloped baffle. The water would be assisted in turning toward the nozzles by two vertical weirs positioned toward the center of the flume, perpendicular to the longitudinal axis of the flume in the distribution pan and extending from underneath the flume into the distribution pan. The water would exit the flume side adjacent to the nozzles and would flow over a sloped weir positioned parallel to the flume and between the flume and the section of the basin containing flow nozzles.

In another such arrangement which has been used for small crossflow towers, the hot water to be cooled would be fed from above the basin to a flume which was positioned above the distribution basin. The water would be deflected toward either side of the flume by a deflecting angle positioned directly underneath the hot water supply piping. The hot water would flow toward the edges of the flume and would flow down into two openings positioned in the back corner and at the bottom of the flume and would then flow underneath the flume and into the distribution pan containing the flow metering nozzles.

Although the methods described have been successfully utilized to provide even water distribution to a distribution basin where the hot water to be cooled is supplied from above the center of the basin, it is advantageous for several reasons if the hot water can be supplied to the basin from underneath. For example, a bottom-fed distribution system would require less pump energy than an top-fed system since the water would not have to be raised to a level above the basin. Also, a cooling tower utilizing a bottom-fed distribution system would require less field labor to install and would be more aesthetically pleasing as it would eliminate unsightly pipework above the cooling tower which must necessarily be present in a top-fed distribution system.

In distribution systems of the bottom-feed type, it is generally impractical to centrally locate the hot water supply piping in the distribution basin due to the presence of the heat transfer surface underneath the basin—though this arrangement would be preferred from a water distribution viewpoint. It is also impractical to locate the hot water supply pipe at the center of the back, inner side of the distribution basin due to the presence of the fan in that area of most crossflow cooling towers. Accordingly, one possible location where fluid may be supplied to a bottom-fed distribution system without unnecessarily increasing the overall size of the cooling tower and while maintaining the tower's pleasing aesthetic appearance is to feed the distribution system asymmetrically from one back corner of the distribution pan.

In a bottom-fed distribution system where the point of supply is at one corner of the distribution pan the distance within the basin from the supply point to the nozzle furthest away is over twice as large as in the centrally located overhead system. Additionally, the volume of water per unit of flow area is also approximately doubled, thereby increasing the possibility of water turbulence within the basin.

One method that has been used to feed a distribution basin from one corner involved laying a perforated pipe inside the basin with the perforated section of the pipe being centrally located in the basin. In effect, the water was piped to the center of the basin and then dispersed through the perforations. This method provided satisfactory distribution at relatively low water flows, however, at high water flows like those associated with a typical crossflow cooling tower, the distribution pipe size required became too large to fit within the basin.

SUMMARY OF THE INVENTION

The distribution system of the present invention is a corner-located, bottom feed distribution system providing uniform fluid distribution to a distribution pan containing gravity flow metering nozzles. When used in a crossflow cooling tower, the present invention allows for the elimination of overhead hot water piping thereby reducing the pump energy required and producing a more aesthetically pleasing cooling tower while providing uniform water distribution to an underlying heat transfer surface.

The distribution system of the present invention comprises a distribution pan, an inlet chamber, and a fluid transporting flume. The distribution pan is of a typical shape with a bottom and four sides. Fluid metering nozzles or orifices are located in the bottom of the distribution pan. Flow directing baffles are positioned in the corner of the distribution pan formed by the distribution pan bottom and back side. When used in a crossflow cooling tower, the distribution pan would be positioned in the tower such that the heat transfer media would be located directly below the nozzle openings.

The inlet chamber of the present invention is located adjacent to a rear corner of the distribution pan. This chamber has an horizontally oriented inlet at its bottom side to connect to the fluid supply pipe rising up from below the distribution system. The inlet chamber also has a vertically oriented outlet at one side which is connected to the distribution pan to allow the fluid to flow out of the inlet chamber. With the exception of these openings, the inlet chamber is totally enclosed on all sides to contain the fluid flowing therein.

The fluid transporting flume is positioned inside, and along the back edge, of the hot water distribution pan. This flume extends the entire length of the basin such that the longitudinal axis of the pan and the longitudinal axis of the flume are parallel. The flume has a top, one side, a partial bottom, and an internal baffle. The flume is elevated above the bottom of the distribution pan such that a space for fluid flow is created between the bottom of the flume and the distribution pan bottom. The bottom of the flume has an opening, or gap, that extends the entire length of the flume. This opening is located on the side of the flume bottom which is adjacent to the back side of the distribution pan, or the side of the flume furthest away from the distribution pan nozzles. A weir is positioned in the distribution pan underneath the flume and extends the entire length of the flume.

In operation, the fluid to be distributed is transported through a riser pipe to the bottom of the inlet chamber. The fluid flows through the inlet chamber, decreasing in velocity through the chamber as the cross-sectional flow area of the inlet chamber increases, and upon exiting the inlet chamber, enters the distribution pan. In entering the distribution pan, a portion of the fluid flows down into the opening in the bottom of the flume while the majority of the fluid enters the fluid transporting flume. Once in the flume, a portion of the fluid flows down into the opening in the bottom of the flume while the remainder of the stream flows further down the flume, being supported by the flume bottom. This process of flowing down through the opening in the bottom of the flume continues over the entire length of the flume. Once the fluid has passed out of the bottom of the flume, it reverses direction, flows underneath the flume, over the weir, and into the section of the distribution pan wherein the nozzles are . located. By this manner of operation, a uniform head of water can be provided throughout the distribution basin and fluid is evenly distributed below the distribution system.

DETAILED DESCRIPTION

Figure 1:
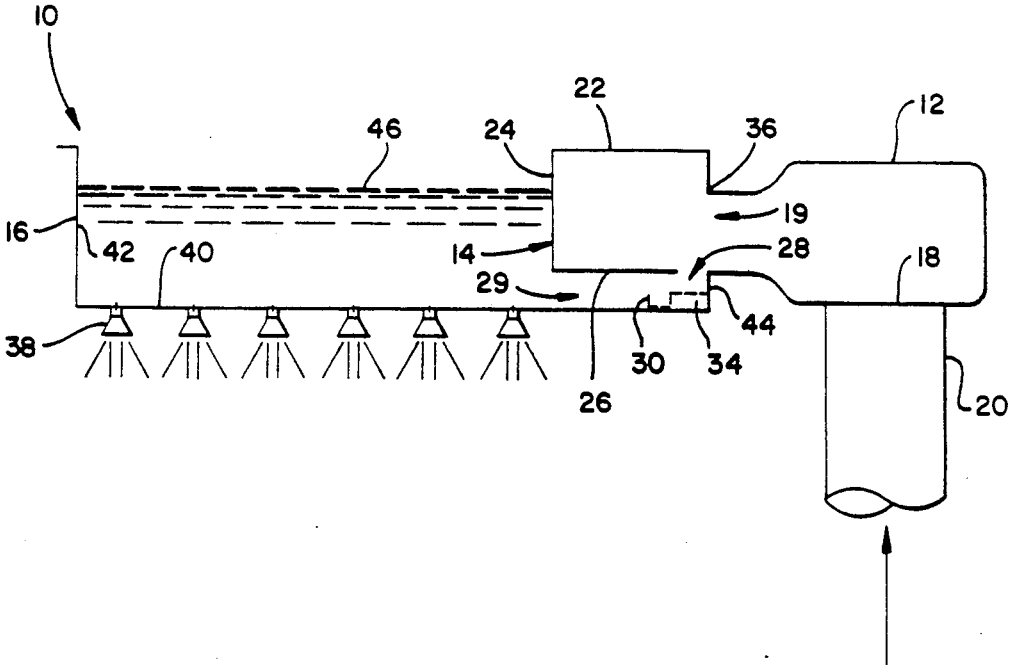
FIG. 1 is a cross-sectional view of the distribution system of the present invention when operating at high fluid flow and showing the distribution pan, fluid transporting flume, inlet chamber, and supply piping.
Figure 2:
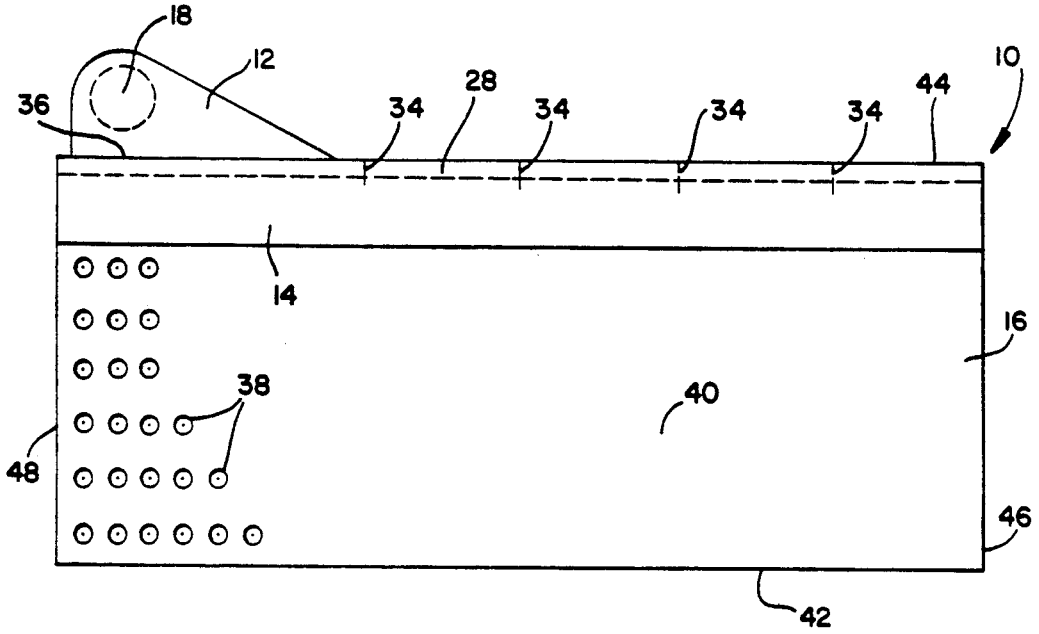
FIG. 2 is a plan view of the distribution system of the present invention.

Referring to FIGS. 1 and 2, there is shown generally at 10 the distribution system of the present invention. FIG. 1 shows distribution system 10 in cross-section while FIG. 2 is a plan view of distribution system 10. Identical reference numerals are used in each figure when referencing the same component.

As shown in FIG. 1, distribution system 10 is comprised of inlet chamber 12, fluid transporting flume 14, and distribution pan 16. Inlet chamber 12 is enclosed on all sides. However, inlet chamber 12 includes an opening 18 to allow fluid to flow into inlet chamber 12 from supply piping 20 and also includes an opening 19 to allow fluid to flow out of inlet chamber 12 into flume 14. Opening 19 is typically of a rectangular shape of dimensions approximately 5 inches high by 36 inches long. Opening 18 is circular and is typically of a diameter in the range of 6–12 inches. Accordingly, the cross-sectional flow area of opening 19 is generally larger than that of opening 18 such that the fluid leaving inlet chamber 12 through opening 19 has a lower velocity than the fluid entering chamber 12 through opening 18.

Inlet chamber 12 is preferably manufactured of a plastic material, such as polyethylene or polypropylene, to allow inlet chamber 12 to be molded in one piece. Inlet chamber 12 could, however, be constructed of other materials and could be designed as an assembly of several different components.

Inlet chamber 12 is connected to distribution pan 16 at connection port 36 and, as shown on FIG. 2, is positioned at one end of distribution pan 16. Located within distribution pan 16 is fluid transporting flume 14 which is comprised of top 22, side 24, and bottom 26. Bottom 26 has an opening 28 which runs the length of the flume and is located on the side of flume adjacent to inlet chamber 12. Opening 28 is typically 2–4 inches wide. Fluid transporting flume 14 is typically constructed of galvanized steel, though it may be constructed of alternative materials such as fiberglass reinforced polyester, wood, or plastic materials, among others. The typical cross-sectional size of fluid transporting flume 14 would be about 7–12 inches high by about 8–16 inches wide. Such flumes would be of a longitudinal length of about from 6–20 feet, with the length of the flume generally being approximately equal to the length of distribution pan with which the flume is used.

Fluid transporting flume 14 is usually positioned adjacent to the back side of distribution pan 16 with the longitudinal axis of flume 14 generally parallel with the longitudinal axis of distribution pan 16. Also, fluid transporting flume 14 is elevated above the distribution pa bottom 40 such that gap 29 is created between flume bottom 26 and pan bottom 40.

Distribution pan 16 comprises a bottom 40, front side 42, back side 44, and ends 46 and 48, as shown on FIG. 2. Fluid metering nozzles, or orifices, 38 are positioned in bottom 40 to allow fluid to flow from distribution pan 16 through bottom 40. Fluid metering nozzles 38 are generally of the gravity flow type such that the flow through the nozzles is dependent upon the type of nozzle, size of the nozzle opening and the head, or height, or fluid above the nozzle opening. For simplicity of design and manufacture, it is preferable that all fluid metering nozzles 38 be of the same type and have the same size nozzle opening. As a result, in order to achieve uniform fluid distribution from the distribution pan, it is important that the same head of fluid be present throughout the basin.

Distribution pan 16 is typically constructed of galvanized steel although other materials of construction, such as fiberglass reinforced polyester, wood, or various plastics, may be used. Distribution pan 16 will typically be about 6–14 inches in depth and can range from about 2–5 feet in width and 6–20 feet in length.

Distribution pan 16 also comprises weir 30 which is affixed to pan bottom 40 underneath flume 14 in space 29. Weir 30 typically extends the entire length of distribution pan 16 and is positioned such that its longitudinal axis is parallel to the longitudinal axis of distribution pan 16. Weir 30 is usually located about 4–7 inches from back side 44 of distribution pan 16. The purpose of weir 30 is to slow and eve the fluid flow through opening 29 to assist in providing uniform fluid distribution into the section of distribution pan 16 containing the fluid metering nozzles 38. Weir 30 is typically positioned in a substantially vertical direction though in some cases it may be positioned at an angle from between 0° to 60° from vertical.

Distribution pan 16 also comprises four flow directing baffles 34. These baffles are affixed to distribution pan 16 at the corner of pan 16 created by pan bottom 40 and back side 44. Flow directing baffles 34 are generally only several inches long and 1–3 inches in height. FIG. 2 illustrates the locations along the longitudinal axis of distribution pan 16 that flow directing baffles 34 are located. As can be seen from this figure, one of the flow directing baffles is located slightly offset from the edge where inlet chamber 12 is connected to fluid transporting flume 14. The remaining three flow directing baffles are generally spaced equidistant from each other between the location of this first flow directing baffle and end 46 of distribution pan.

The purpose of flow directing baffles 34 is to assist in directing the fluid flowing down through opening 28 in the bottom of flume 14 toward the distribution pan 16. These baffles are needed especially in situations of high fluid flow. In these cases, the fluid flows down bottom 26 of flume 14 at a high velocity and as a result, flows down into opening 28 with a substantial velocity vector in the longitudinal direction of the flume. Flow directing baffles 34 re-direct the fluid and assist in turning the fluid 90° toward the portion of distribution pan 16 containing flow metering nozzles 38.

Referring again to FIG. 1, the operation of the present invention for instances of high fluid flow will be explained. Fluid is supplied to inlet chamber 12 via riser piping 20 through opening 18. Upon entering inlet chamber 12, the direction of fluid flow is changed 90° from flowing substantially vertical to substantially horizontal. At high flows, inlet chamber 12 is completely filled with fluid. The fluid exits inlet chamber 12 through opening 19 and the majority of the fluid enters flume 14 which is located within distribution pan 16 while a small portion flows down into opening 28 directly into distribution pan 16. Upon entering flume 14, the direction of the fluid is again changed from flowing in a diagonal direction from inlet chamber 12 to a longitudinal direction substantially parallel to the longitudinal axis of flume 14. Again at high flows, flume 14 is generally completely filled with fluid. As the fluid flows down flume 14, a portion of fluid continuously flows down through opening 28 all along the length of flume 14 while the remaining fluid is supported by bottom panel 26 and is transported down flume 14.

Upon flowing through opening 28, the direction of fluid flow is reversed by its contact with distribution pan back side 44, is redirected in a substantially horizontal direction by its contact with distribution pan bottom 40 and is turned by flow directing baffles 34 in a direction parallel with the transverse axis of distribution pan 16 such that the fluid flows underneath flume 14. In flowing underneath flume 14, the fluid encounters weir 30 which acts to restrict and even out the fluid flow. After passing over weir 30, the fluid continues to flow underneath flume 16 and into the section of distribution pan 16 containing flow metering nozzles 38.

The operation and configuration of distribution system 10 provides uniform fluid level 46 throughout distribution pan 16 by receiving the fluid at one corner and transporting and distributing the fluid by means of flume 14 along the longitudinal length of distribution pan 16. In effect, the fluid is fed along the longitudinal length of distribution pan 16 in a direction transverse to the longitudinal axis of distribution pan 16 such that the distance from the point of fluid feed to the furthest nozzle 38 is minimized. Also, since opening 29, which is the effective point of fluid feed into distribution pan 16, is positioned below the fluid level, the entrance of the fluid into the basin is dampened by the fluid in distribution pan 16 resulting in a decreased amount of turbulence within distribution pan 16.

Figure 3:
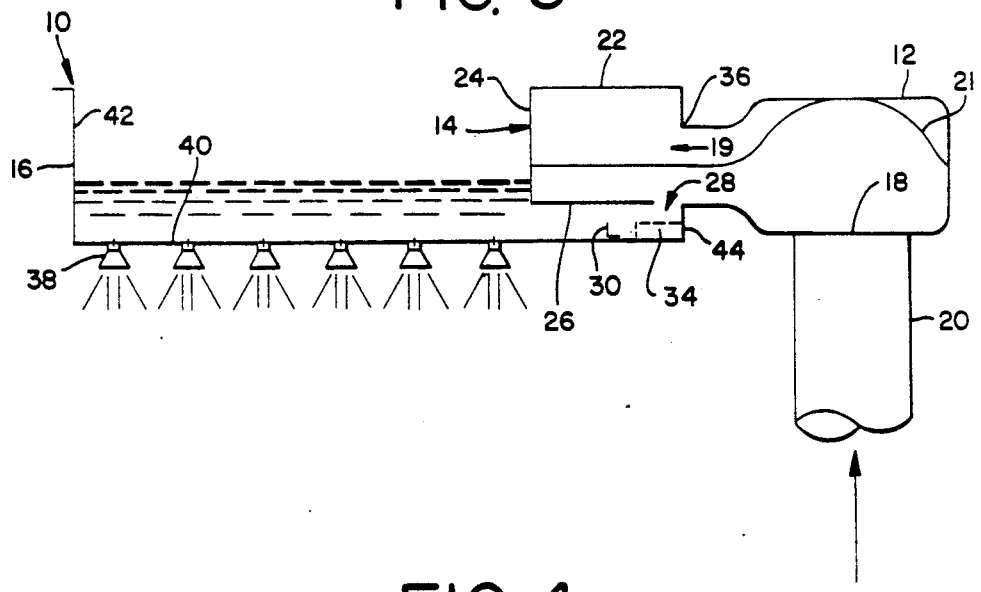
FIG. 3 is another cross-sectional view of the distribution system showing the system operating at low fluid flow.

Referring now to FIG. 3, the operation of the distribution system of the present invention will be explained for the case of low fluid flow. The reference numerals used in FIG. 3 are identical to those used in FIGS. 1 and 2 when referencing the same component.

As in the high flow case, fluid enters inlet chamber 12 from supply piping 20 through inlet 18. Upon entering inlet chamber 12, the direction of fluid flow is changed from substantially vertical to substantially horizontal and the fluid flows toward exit 19. The velocity of the fluid flowing through exit 19 is lower than was the velocity of the fluid flowing through inlet 18 due to the increased cross-sectional flow area of exit 19.

Upon exiting inlet chamber 12, the fluid enters distribution pan 16 whereby a portion of the fluid flows downward into opening 28 while the majority of fluid flows into flume 14. Once in flume 14, flume bottom 26 operates to transport the fluid longitudinally down flume 14. As the fluid flows down flume 14, however, a portion of the fluid flows down into opening 28. This occurs continuously along the length of flume 14 resulting in a uniform water flow down into opening 28 along the length of the flume.

Note that in the low flow application, inlet chamber 12 and flume 14 are not completely filled with fluid as in the high flow instance. In fact, a typical fluid profile in low flow applications is shown as 21 on FIG. 3.

After flowing down into opening 28, the fluid is directed underneath flume bottom 26 by pan bottom 40 and flow directional baffles 34. In low flow applications, flow directional baffles 34 are not needed to provide uniform fluid head within the distribution pan since the velocity vector in the longitudinal direction of the fluid flowing down through opening 28 is not excessive. However, the presence of flow directional baffles 34 do not hinder uniform distribution and thus, provide the distribution system with flexibility to operate successfully at a wide range of fluid flow rates.

In passing underneath flume bottom 26, the fluid then flows over weir 30, which again assists in evening the fluid flow, and then flows toward the section of distribution pan 16 containing flow metering nozzles 38. The fluid enters this section of distribution pan 16 at a level below the fluid level in distribution pan 16.

Figure 4:
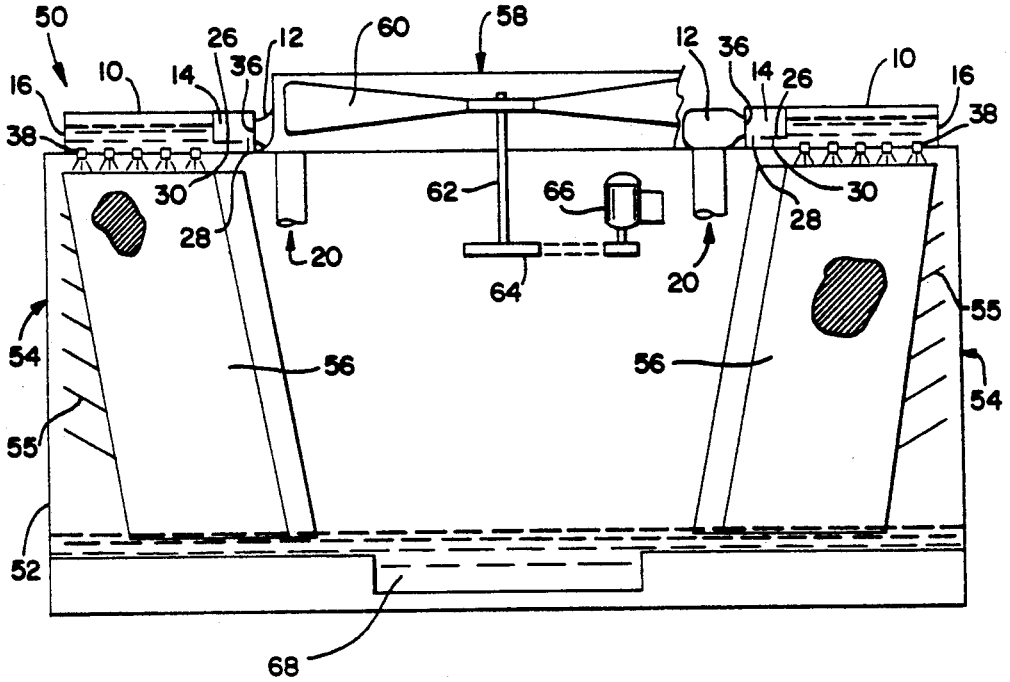
FIG. 4 is a side elevational, cross-sectional view of a crossflow cooling tower utilizing the distribution system of the present invention.

One application where the distribution system of the present invention could be utilized is in distributing hot water to be cooled to the heat transfer media in a cross-flow cooling tower. Referring now to FIG. 4, there is shown generally at 50 an elevational, cross-sectional view of a cross-flow cooling tower utilizing the distribution system of the present invention. Cross-flow cooling tower 50 is generally comprised of enclosure 52 in which is contained cooled water collection sump 68 and heat transfer media 56. Heat transfer media 56 typically comprises a plurality of sheets arranged in a bundle and supported from the sides of enclosure 52.

Enclosure 52 also comprises two air inlet openings 54 positioned on opposite sides of tower 50. At air openings 54 are placed air inlet louvers 55 which prevent water flowing down through heat transfer media 56 from splashing outside of tower 50 during operation.

Enclosure 52 also comprises air outlet opening 58 which is generally positioned at the top of, and in the center of enclosure 52. Within air outlet 58 is positioned fan 60 which is typically an axial flow fan. Fan 60 would generally range in size from about 6 feet to 16 feet in diameter. Fan 60 is affixed to shaft 62 which is driven via belt and sheave apparatus 64 by motor 66. Instead of using a belt and sheave apparatus, a gear drive arrangement could also be used.

Located at the top of enclosure 52 and positioned over both of the heat transfer media 56 is a distribution system 10 of the present invention. As described previously, distribution system 10 comprises distribution pan 16, fluid transporting flume 14, and inlet chamber 12. Spaced in the bottom of distribution pan 16 are fluid metering orifices 38.

Inlet chamber 12 is positioned at the back edge and at one corner of distribution pan 16. Note that one side of air outlet 58 and fan 60 are shown in a cut-away view in order to clearly show the position of inlet chamber 12. Inlet chamber 12 is connected at its bottom to supply pipe 20 which passes up through the interior of tower 50. The outlet of inlet chamber 12 is connected to the back side of distribution pan 16 at connection port 36. Flume 14 is positioned along the inside of the back side of distribution pan 16 with the longitudinal axis of flume 14 being parallel to the longitudinal axis of distribution pan 16.

Flume 14 has a bottom 26 and has an opening 28 located at the side of bottom 26 adjacent to the back side of distribution pan 16. Opening 28 extends the entire length of flume 14 and distribution pan 16. Distribution pan 16 also comprises weir 30 which is positioned underneath flume 14 and extends approximately the entire length of distribution pan 16.

Figure 5:
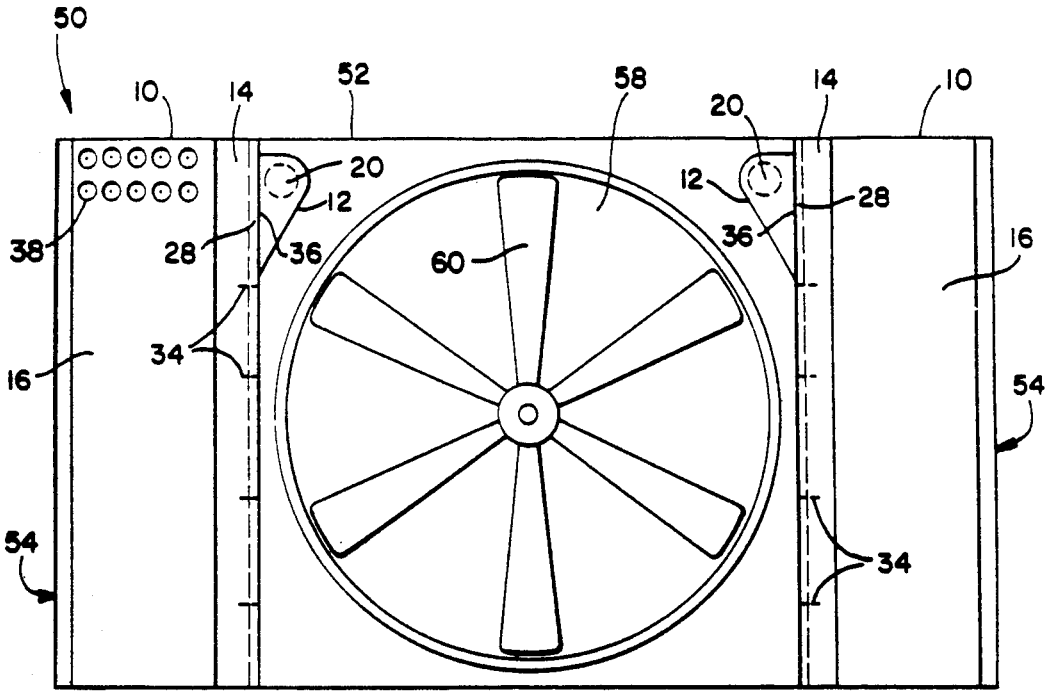
FIG. 5 is a plan view of the cross-flow cooling tower of FIG. 4.

Referring now to FIG. 5, there is shown a plan view of cooling tower 50. The reference numerals used in FIG. 5 are identical to those used to reference the same components in FIG. 4. As shown on FIG. 5, cooling tower 50 comprises an enclosure 52, two air inlets 54, air outlet 58 and fan 60. Situated at opposite ends of enclosure 52 are distribution systems 10 which comprise distribution pan 16, fluid transporting flume 14, and inlet chamber 12. Fluid metering nozzles 38 are spaced in a uniform pattern throughout the bottom of distribution pan 16, though only a portion of this nozzle pattern is shown.

Supply piping 20 is connected to the bottom of inlet chamber which, in turn, is connected to distribution pan 16. Note that inlet chamber 12 is connected to the back side and at one end of distribution pan 16. Positioned along the inside and along the back side of distribution pan 16 is flume 72. Opening 28 in the bottom of flume 14 is located adjacent to the back side of distribution pan 16. Distribution pan 16 also comprises flow directing baffles 34 which are positioned at the corner of distribution pan 16 formed by its bottom and back edge. As described previously, flow directing baffles 34 are positioned along the longitudinal length of distribution pan 16 with the first such baffle being slightly offset from the connection of inlet chamber 12 to distribution pan 16 and with the remaining flow directing baffles 34 being spaced equidistant to the edge of distribution pan 16.

Figure 6:
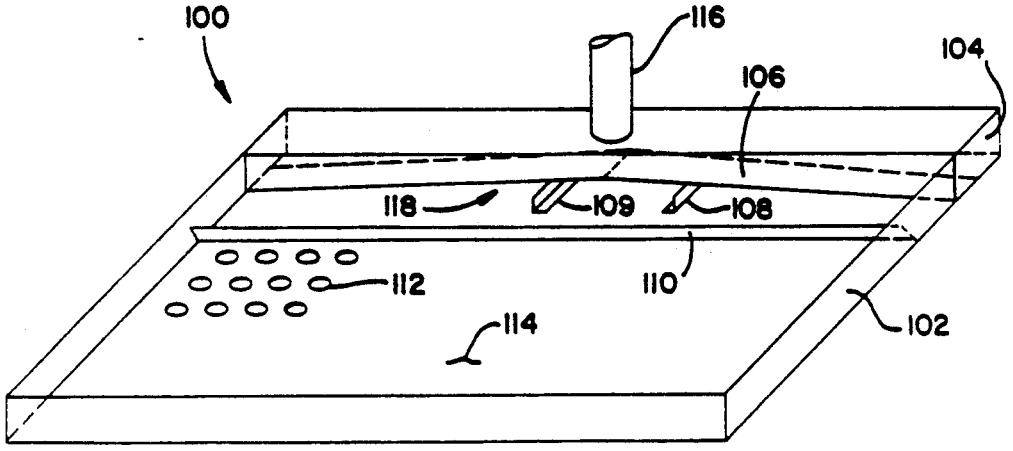
FIG. 6 PRIOR ART
FIG. 6 is a Prior Art drawing showing an isometric view of a prior art water distribution system typically used in crossflow cooling towers.

For reference purposes, FIG. 6 shows a typical prior art, top feed distribution system used on crossflow cooling towers. Prior art distribution system shown generally at 100 comprises distribution pan 102, flume 104 and supply piping 116. Flume 104 further comprises sloped baffle 106 which is sloped from the center to either edge of flume 104. Sloped baffle is positioned above opening 118 in the side of flume 104 adjacent to distribution pan 102. Distribution pan 102 further comprises flow nozzles 112, sloped weir 110 and two vertical weirs 108 and 109. Note that supply piping 116 feeds into flume 104 from the top and at the center of flume 104. This is substantially different from the distribution system of the present invention where the distribution system is fed from the underneath and from only one side, or asysmmetrically.

Referring back to FIG. 5, note also that the distribution system of the present invention allows for the feeding of fluid from underneath the distribution system without increasing the overall length of cooling tower 50. By positioning inlet chamber 12 at one end of distribution pan 16, it is possible to maintain air outlet 58 close to the longitudinal midpoint of distribution pan 16, thereby minimizing the overall length of cooling tower 50.

Also, although the present invention has been described as a bottom feed distribution system, it is anticipated that the present invention could also be used in a top feed distribution system where the fluid is fed from above and at one corner of the distribution pan. The foregoing description has been given to clearly define and completely describe the present invention. Various modifications may be made without departing from the scope and spirit of the invention which is defined in the following claims.

I claim:

1. A fluid distribution system for a cooling tower providing cooling fluid to a heat exchange application, said fluid having its temperature reduced from an as-received temperature at a tower inlet fluid supply pipe, said tower having an enclosure, heat transfer media, and an exhaust fan, said system comprising:

a distribution pan having a pan bottom, a front side, a back side, a first end and a second end cooperating to define a pan basin, said distribution pan positioned above said heat transfer media;

at least one flow metering nozzle positioned in said pan bottom for fluid transfer from said basin to said heat-transfer media;

a flume top, a flume side, and a flume bottom cooperating to define a flume for transport of cooling fluid and a flume connecting port, said flume having a longitudinal axis, said flume bottom defining an opening for discharge of said fluid from said flume, which opening is generally parallel to said longitudinal axis;

an inlet having a chamber, a first opening and a second opening, one of said first and second openings coupled to said supply pipe for transfer of spent cooling fluid at said as received temperature from said heat exchange application to said inlet chamber, which inlet is positioned along said pan back side in proximity to one of said pan first and second ends;

said flume mounted in said basin at said pan back side with said connecting port coupled to the other of said inlet first and second openings to provide fluid transfer from said inlet chamber to said flume, said flume operable to transfer and evenly distribute said as-received-temperature fluid through said flume opening to said basin to provide a substantially uniform static fluid pressure head to each of said at least one flow metering nozzles.

2. A fluid distribution system as claimed in claim 1 wherein said flume-bottom opening is in proximity to said pan back side.

3. A fluid distribution system as claimed in claim 1 wherein said cooling fluid is water.

4. A fluid distribution system as claimed in claim 1 wherein said distribution pan has a longitudinal axis substantially parallel to said flume longitudinal axis.

5. A fluid distribution system as claimed in claim 4 wherein said flume bottom is displaced above said pan bottom.

6. A fluid distribution system as claimed in claim 1 wherein said one of said first and second inlet openings has a first cross-sectional area and the other of said first and second inlet openings has a second cross-sectional area greater than said first cross-sectional area.

7. A fluid distribution system as claimed in claim 6 wherein said inlet has an inlet side and an inlet bottom, which inlet bottom is generally horizontal, said one of said first and second inlet openings provided in said inlet bottom and connected to said fluid supply pipe, said inlet side provided in a generally vertical orientation to said inlet bottom with the other of said first and second inlet openings provided in said inlet side, which other of said first and second inlet openings is coupled to said flume connecting port, said inlet operable to communicate said spent fluid from said supply pipe to said flume at about a right angle to said supply pipe.

8. A fluid distribution system as claimed in claim 7 further comprising a weir with a longitudinal weir-axis affixed to said distribution-pan bottom in said basin beneath said flume bottom, said longitudinal weir-axis about parallel with said flume longitudinal axis, said weir being generally normal to said distribution-pan bottom and extending approximately the length of said distribution pan.

9. A fluid distribution system as claimed in claim 8 further comprising a plurality of baffle plates;

said distribution pan bottom and back side intersecting to define a corner at the intersection;

said baffle plates mounted in said basin at said corner and extending from said back side generally toward said front side, said baffle plates spaced along said back side from said one pan end at the inlet mounting to the other of said pan first and second ends, which baffle plates operate to direct said fluid from said flume opening in a direction toward said nozzles in said distribution pan bottom.

10. In a cooling tower and heat exchange apparatus assembly with a cooling fluid distribution system, a method of supplying fluid to an inlet, a distribution pan and a flume with a longitudinal axis, a flume bottom, a first flume end, a second flume end and an opening in said flume bottom, said pan having a pan bottom with a plurality of gravity-fed nozzles therein, said method comprising:

communicating in a generally vertical direction spent cooling fluid from said heat exchange apparatus to an inlet of said distribution system, which inlet and flume are coupled at one of said first and second flume ends;

turning the direction of fluid flow about 90 degrees to provide said fluid in a generally horizontal direction to said flume;

reducing the fluid flow rate at said vertical direction to a second and lower flow rate in said horizontal direction in said inlet;

passing said fluid in said flume from said inlet in a substantially horizontal direction along the length of said flume and simultaneously communicating at least a portion of said fluid in said flume through said flume opening to said pan; and, turning the direction of fluid flow in said distribution pan approximately perpendicular to the flume longitudinal axis to about uniformly provide said fluid to said plurality of gravityfed nozzles for transfer to said cooling tower.

11. The method of supplying fluid to a distribution system and cooling tower as claimed in claim 10, said method further comprising passing said fluid discharging from said flume opening from beneath said flume bottom to said pan bottom.

12. The method of supplying fluid to a distribution system and cooling tower as claimed in claim 11 further comprising:

mounting a weir on said pan bottom; and passing said fluid from said flume opening and flume end over said weir at said pan bottom to provide a more quiescent fluid flow and even fluid distribution at said pan bottom.

13. An improved crossflow cooling tower having at least one enclosure for heat transfer media, each said enclosure having an air inlet, an air outlet, a bottom and a top;

heat transfer media with a heat transfer surface positioned in each said enclosure;

means for moving air through said enclosure to provide air flow from the air inlet across said heat transfer surface for discharge from said air outlet;

a sump at said enclosure bottom to collect cooled water flowing across the heat transfer surface;

means for about uniformly distributing water to said heat transfer media, which distributing means is generally positioned above the heat transfer surface, said water distributing means comprising:

a water distribution pan with a basin, a back side, a first end, a second end and a pan bottom;

a flume for transporting fluid mounted in said basin above said pan bottom in proximity to said pan back side, said flume having a flume bottom, and an opening in said flume bottom along a length of said flume, said opening positioned in said flume bottom in closest proximity to said pan backside and operable to pass water from said flume to said basin;

an inlet with a chamber mounted at said pan back side and at one of said pan first and second ends, said inlet connected to said flume and pan;

a riser pipe in said enclosure generally vertically extending through said enclosure and enclosure top, said pipe coupled to said inlet for communication of water to said inlet chamber, said flume and said basin at said pan back side and one end.

14. A crossflow cooling tower as claimed in claim 13 further comprising a plurality of nozzles positioned in said pan bottom and operable to communicate fluid from said basin to said heat transfer media, said flume bottom, said pan bottom and pan back side cooperating to define a passageway beneath said flume for said water flowing from said flume opening and to provide said water to said nozzles.

15. A crossflow cooling tower as claimed in claim 14 wherein said tower has an outer edge;

said air outlet has a circular shape with a circumference;

said water distribution pan is rectangular in plan view, said pan back side having a midpoint in proximity to said air-outlet circumference; and, said pan back side, said air outlet and an edge of said cooling tower cooperate to define a volume for mounting said inlet.

* * * * *